United States Patent [19]

Bartzick et al.

[11] Patent Number: 4,516,488

[45] Date of Patent: May 14, 1985

[54] SUPPORT AND TENSIONING APPARATUS FOR TENSIONING A STRAPPING BAND ABOUT A PACKAGE

[75] Inventors: Günter Bartzick, Ennepetal; Gerd Bühne, Schwelm; Reinhard Naydowski, Remscheid, all of Fed. Rep. of Germany

[73] Assignee: Hoesch Werke Aktiengesellschaft, Dortmund, Fed. Rep. of Germany

[21] Appl. No.: 498,259

[22] Filed: May 26, 1983

[30] Foreign Application Priority Data

May 29, 1982 [DE] Fed. Rep. of Germany ..... 3220446

[51] Int. Cl.[3] ..... B65B 13/22

[52] U.S. Cl. ..... 100/4; 53/589; 100/26; 100/32

[58] Field of Search ..... 100/4, 29, 32, 26; 53/589; 140/93.2

[56] References Cited

U.S. PATENT DOCUMENTS 3,526,187 9/1970 Gilliard ..... 100/26 X
4,212,238 7/1980 Simmons ..... 100/32
4,218,969 8/1980 Kasuga ..... 100/32

FOREIGN PATENT DOCUMENTS 1161827 8/1969 United Kingdom ..... 100/26

*Primary Examiner*—Billy J. Wilhite
*Attorney, Agent, or Firm*—Max Fogiel

[57] ABSTRACT

Support and tensioning apparatus for a strapping band to be tensioned around a package. A band first pressed between a pair of wheels and advanced in a band guide that surrounds but does not contact the package. The band is subsequently retracted with its front end secured in place into a position against the package by reversing the sense in which the pair of wheels rotates, and is then tensioned with a separate tensioning wheel that rotates slowly and at high power. The strapping band is tensioned with a pair of wheels of which one wheel is an idler wheel and the other wheel is a tensioning wheel powered in the tensioning direction by a motor and with its shaft mounted in a pivoting lever in such a way that the wheel presses against the strapping band, which is to some extent looped around it, while the band is being tensioned and rests on the idler wheel, with a force that increases with the tension in the band.

19 Claims, 2 Drawing Figures

SUPPORT AND TENSIONING APPARATUS FOR TENSIONING A STRAPPING BAND ABOUT A PACKAGE

Figure 1:
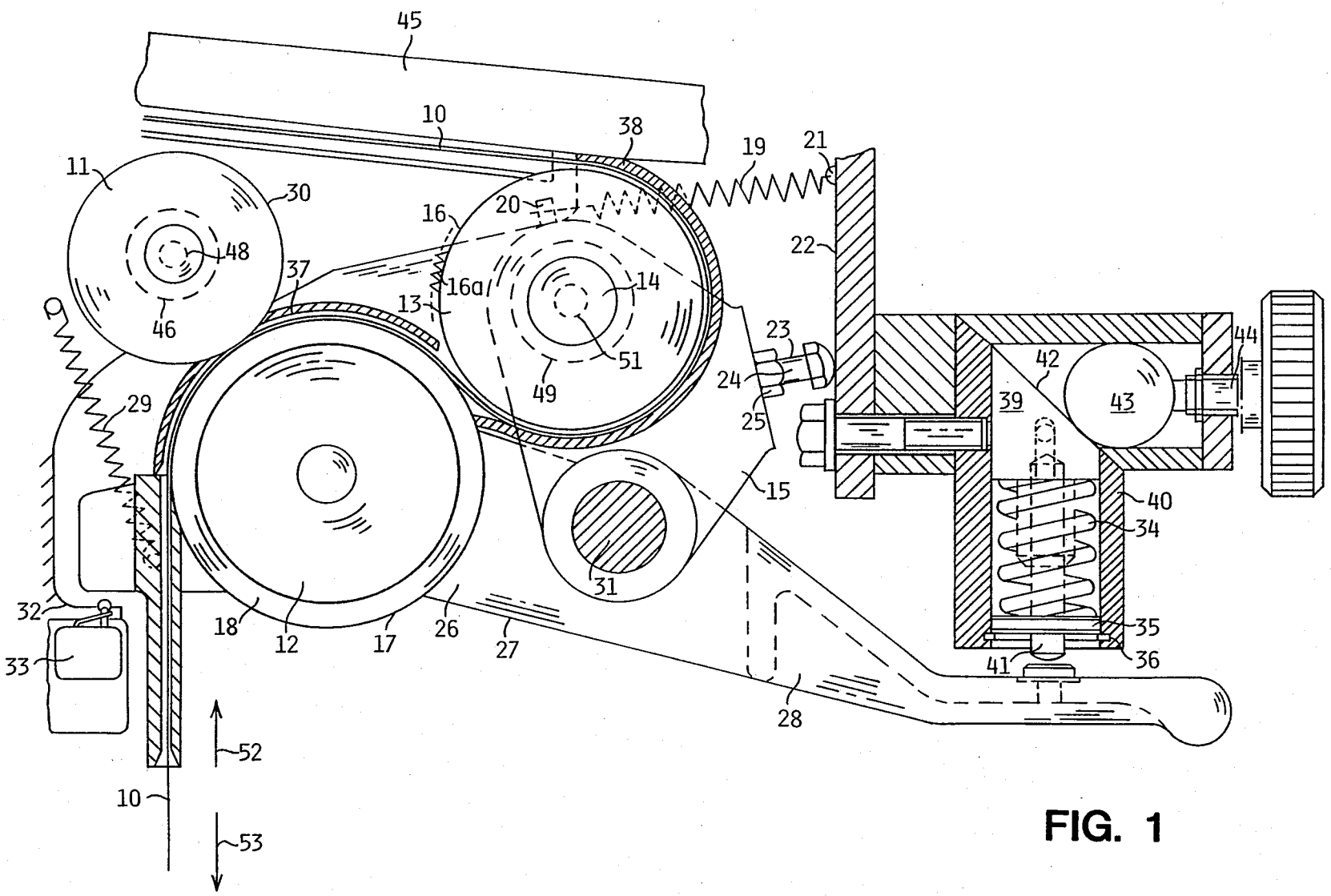

The invention concerns a support and tensioning apparatus for a strapping band to be tensioned around a package, a band that can first be pressed between a pair of wheels and advanced in a band guide that surrounds but does not contact the package, subsequently retracted with its front end secured in place into a position against the package by reversing the sense in which the pair of wheels rotates, and then tensioned with a separate tensioning wheel that rotates slowly and at high power.

The pair of wheels that advance and retract the wrapping band and the wheel that tensions it in known support, or advance, and tensioning apparatus of this type are powered by a single motor with a reducing gear between the advance and retraction wheels and the tensioning wheel so that the latter will rotate slower and at a higher power. The strapping band is to some extent looped around the tensioning wheel, which accordingly engages the band frictionally while the band is being tensioned. Since there is a band guide around the tensioning wheel, the strapping band will come into contact only with the inside of the guide and not with the wheel itself while being advanced. While the band is being retracted, the length of band looped around the tensioning wheel comes to rest against it and is frictionally entrained by it, producing the actual tension. The band is tensioned, therefore, by being positioned against the tensioning wheel by the pair of wheels that advance and tension the band while they are rotating in reverse, so that all of the pressure is available for the frictional retension. Since this pressure cannot increase as tensioning continues, the tensioning capability of the tensioning wheel is limited.

The present invention is intended as a support and tensioning apparatus of the type initially described in which these drawbacks are eliminated, with which the band can be advanced, retracted, and tensioned in a simple way, and in which the wheel presses against the strapping band while the band is being tensioned with a force that increases with the tension in the band without permanently deforming the band, especially if it is made of plastic.

This objective is achieved in accordance with the invention in that the strapping band is tensioned with a pair of wheels of which one wheel is an idler wheel and the other wheel is a tensioning wheel powered in the tensioning direction by a motor and with its shaft mounted in a pivoting lever in such a way that the wheel presses against the strapping band, which is to some extent looped around it, while the band is being tensioned and rests on the idler wheel, with a force that increases with the tension in the band.

This is a simple design for tensioning apparatus that will produce very high tension in the wrapping band while preventing the powered tensioning wheel from sliding along the band even when tension increases because the wheel will press against the strapping band, while the band is being tensioned and rests on the idler wheel, with a force that increases with the tension in the band.

To prevent the strapping band, especially if it is made of plastic, from getting squeezed and deformed, the tensioning wheel rotates in a sense in which one component of its force tends to separate the pair of wheels even though that component is weaker than the pressure generated by the pivoting lever as the result of tension in the band.

Pivoting the tensioning wheel on the pivoting lever and rotating it in that sense is a simple means of countering the pressure generated by the pivoting lever as the result of tension in the band with the component of force derived from the sense in which the wheel rotates so that both forces will not add up to the extent of deforming or destroying the band, especially if it is made of plastic. The component of force deriving from the sense in which the tensioning wheel rotates can be very weak because the only essential for protecting the wrapping band, especially one made of plastic, is that pressure does not increase as the result of the sense in which the tensioning wheel rotates.

The metallic surface of the tensioning wheel can be knurled or provided with other irregularities to increase its coefficient of friction. This is a simple means of preventing the strapping band from sliding along the surface of the powered tensioning wheel.

The surface, that lies against the strapping band, of the idler wheel can also consist of an anti-friction, low-elasticity layer. When the tensioning wheel is forced against a strapping band supported on the idler wheel, the tensioning wheel presses, along with the band lying around it, into the anti-friction, low-elasticity layer until an extensive area of the band rests against both the idler wheel and the tensioning wheel. This is a simple means of avoiding damage to a strapping band, especially one made of plastic.

The powered tensioning wheel can also deflect the strapping band so that the length of band extending to the package at least approximately parallels the direction in which the tensioning wheel, which is mounted on the pivoting lever, is applying pressure. This is a simple means of ensuring that the increasing tension in the band as the band rests on the idler wheel will cause the tensioning wheel to press against the band with increasing force.

The powered tensioning wheel mounted on the pivoting lever can be pressed against the strapping band supported on the idler wheel against the force of a spring that engages the lever. This is a simple means of ensuring that the tensioning wheel will tend to assume a position in which its pressure is very low or non-existent.

The powered tensioning wheel mounted on the pivoting lever can, before tensioning and while the strapping band is being advanced, be maintained by the spring in an initial position in which the tensioning wheel and its associated idler wheel are separated by an interval that exceeds the thickness of the strapping band and in which they are ready to advance the band. The strapping band can accordingly be fed freely between the tensioning wheel and idler wheel while it is being advanced.

The pivoting lever that supports the tensioning wheel can be supported in the initial position against an immovable limiting surface by an adjustable stop. This is a simple means of adjusting the interval that exceeds the thickness of the strapping band between the tensioning wheel and the idler wheel and that allows the band to be fed freely through it to prevailing conditions.

The pair of wheels that press the strapping band between them and advance and retract it consists of an advance and retraction wheel that is powered to rotate forwards and backwards by a separate motor and of an idler wheel. It is practical for the pair of wheels that advance and retract the band to consist of an advance and retraction wheel that is powered in both senses by its own motor and of an idler wheel. Rotation in one sense advances the band and in the other sense retracts the band.

The idler wheel that operates in conjunction with the powered advance and retraction wheel can be the same wheel that operates in conjunction with the tensioning wheel. The design is considerably simplified by having one idler wheel operate in conjunction with two powered wheels.

The surface of the advance and retraction wheel can be made of polished metal. This reduces the coefficient of friction of the advance and retraction wheel, which can accordingly transfer only advance and retraction forces. Enough force is still transferred to the strapping band, however, to advance it in the band guide that surrounds but does not contact the package. This weak force is also still powerful enough to retract the strapping band into position against the package and against the tensioning wheel when the sense in which advance and retraction wheel rotates is reversed once the front end of the band has been secured. This force is also powerful enough to position the powered tensioning wheel mounted on the pivoting lever against the strapping band that is supported against the idler wheel. At this point the band continues to be retracted, tensioned, that is, by the powered tensioning wheel, with the powered advance and retraction wheel sliding along the band.

The idler wheel can rotate on one pivoting arm of a rocker that is maintained by a spring in an initial position in which the idler wheel is pressed against the strapping band, which is supported on the powered advance and retraction wheel. The spring that engages the rocker accordingly maintains the rocker that carries the rotating idler wheel in an initial position in which the idler wheel is pressed against the strapping band, which is supported on the powered advance and retraction wheel.

The pivoting lever that the tensioning wheel is mounted on and the rocker that the idler wheel is mounted on can pivot on a common journal. Employing only one journal for the two pivoting parts considerably simplifies the design.

The idler wheel mounted on the rocker can be displaced while the strapping band is being tensioned, by the pressure deriving from the powered tensioning wheel and affecting the idler wheel, against the force of the spring into a release position in which the powered advance and retraction wheel and its associated idler wheel are separated at an interval that exceeds the thickness of the band and are ready to tension the band. This is a simple means of releasing the idler wheel from the powered advance and retraction wheel as the tensioning wheel comes into operation to stop the advance and retraction wheel from sliding along the band and prevent damage to the band.

A stop can be associated with the rocker to limit its pivoting motion into the release position. This is a simple means of preventing the rocker from pivoting too far out of the release position.

A switch that can be activated when the release position is attained and that has an adjustable time-lag relay that turns off the motor for the tensioning wheel can be associated with the rocker. When it reaches its release position, therefore the rocker will activate a time-delay switch that turns off the motor that powers the tensioning wheel. The time-lag relay can be simple to adjust so that a pre-determined interval will pass once the switch has been activated before the tensioning-wheel motor turns off. This interval of time will therefore determine the level of tension in the strapping band. The longer the interval the higher the tension.

An adjustably pretensioned accumulator that can be loaded parallel to the direction of pivot and a switch that can be activated once the release position has been attained in order to turn off the motor that powers the tensioning wheel can be associated with the rocker. This is a simple means of precisely controlling the tension in the strapping band because the rocker will have to pivot against the adjustable force of an accumulator before attaining the release position. Attaining the release position will accordingly depend on the tension in the band and the switch that turns off the motor that powers the tensioning wheel will not be activated until the band attains a desired level of tension.

The accumulator that can be loaded parallel to the direction of pivot by the rocker can consist of a helical compression spring, one end of which rests on a piston that is supported against a stop and that operates in conjunction with the rocker and the other end of which rests on a bolt that can be adjusted parallel to the direction of load. The accumulator that consists of a helical compression spring can accordingly easily be set to the desired level of tension, bringing the tension in the wrapping band to the desired level as well.

The adjustable bolt that rests against the accumulator can have a wedge surface that is located on the side facing away from the accumulator and that functions as a seating for a ball the position of which against the wedge surface can be adjusted perpendicular to the direction of load by means of a threaded shaft. Varying the position of the ball against the wedge surface with the threaded shaft is a simple and reliable means of adjusting the pretension of the helical compression spring to the desired level.

Figure 2:
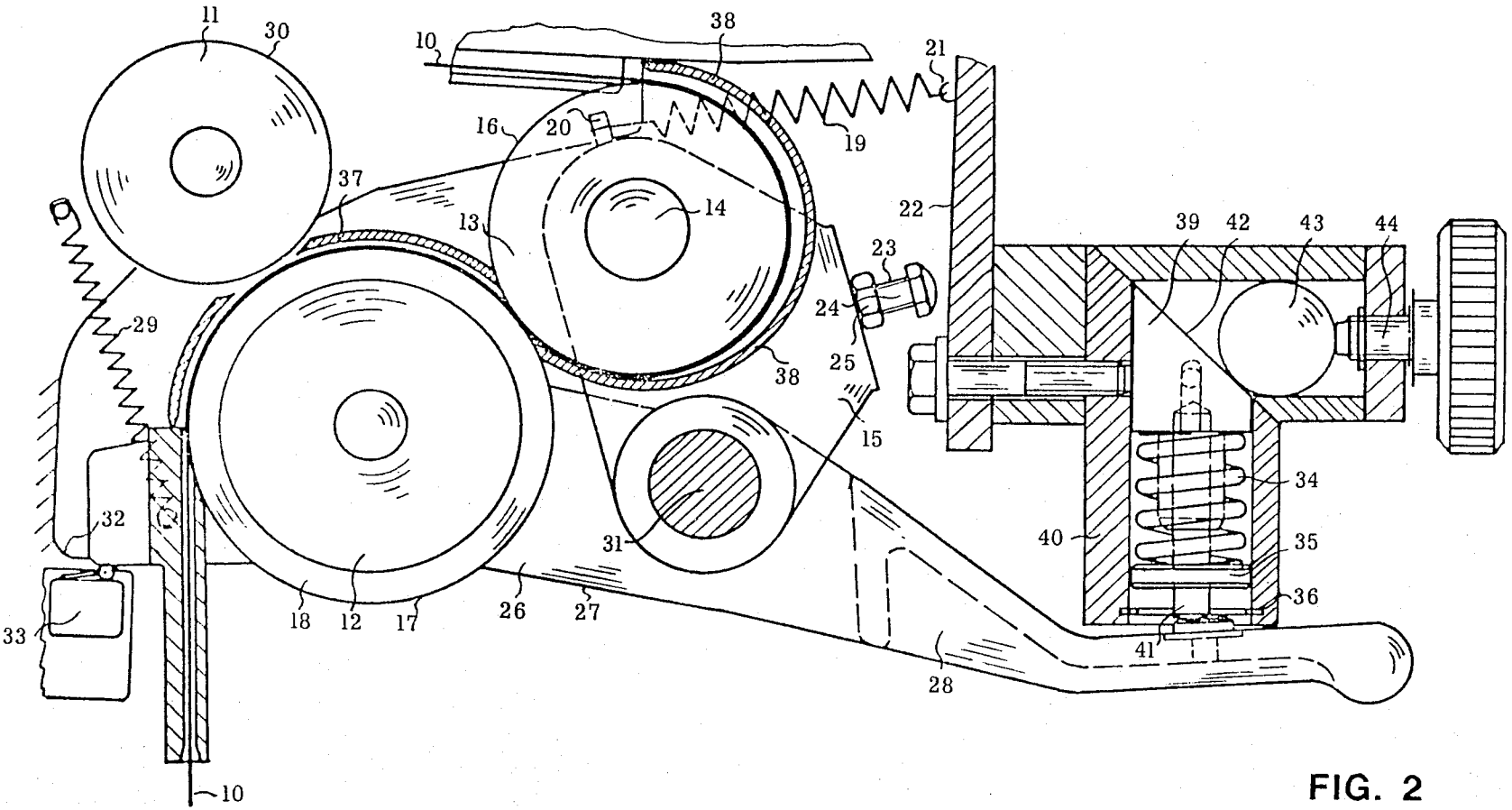

One embodiment of the invention will now be described by way of example with reference to the drawings, in which FIG. 1 is a schematic illustration of apparatus in accordance with the invention for supporting and tensioning a strapping band to be tensioned around a package, with the mechanism in the advancing position and FIG. 2 illustrates the support and tensioning apparatus in the tensioning position.

The apparatus for supporting and tensioning a strapping band 10 to be tensioned around a package, which is not illustrated, has a pair of wheels 11 and 12 that press the band between them and advance it in a band guide 45 that surrounds but does not contact the package. Once the front end of the band has been secured, wheels 11 and 12 begin to rotate in the opposite direction and retract the band until it rests against the package. Once the band is resting against the package, a separately powered tensioning wheel 13 provides strapping band 10 with the requisite tension.

Strapping band 10 is tensioned with a pair of wheels 12 and 13. Wheel 12 is an idler wheel and wheel 13 is powered in the tensioning direction by a motor 49. The shaft 14 of tensioning wheel 13 is mounted in a pivoting lever 15 in such a way that the wheel presses against strapping band 10, while the band is being tensioned and rests on idler wheel 12, with a force that increases with the tension in the band. At this stage the powered tensioning wheel 13 also deflects strapping band 10 so that the length of band extending to the package at least approximately parallels the direction in which the wheel is applying pressure. This is a simple means of ensuring that wheel 13 will press against strapping band 10, while the band is being tensioned and rests on idler wheel 12, with a force that increases with the tension in the band, preventing wheel 13 from sliding along the band even when tension increases.

To prevent strapping band 10, especially if it is made of plastic, from getting squeezed and deformed, tensioning wheel 13 rotates in a sense in which one component of its force tends to separate wheels 12 and 13 even though that component is weaker than the pressure generated by pivoting lever 15 as the result of tension in the band. This is a simple means of preventing the strapping band, especially if it is made of plastic, from getting squeezed and deformed. The force component can be very weak because it is mainly essential only that the pressure generated by the pivoting lever as the result of tension in the band not be increased by the component of force deriving from the sense in which the tensioning wheel rotates.

To prevent it from sliding along strapping band 10, the metallic surface 16 of tensioning wheel 13 is knurled or provided with other irregularities **16*a* to increase its coefficient of friction. There is also an anti-friction, low-elasticity layer 18 on the surface 17, that lies against strapping band 10, of idler wheel 12. When tensioning wheel 13 is forced against a strapping band 10 supported on idler wheel 12, wheel 13 presses, along with the band lying around it, into the anti-friction, low-elasticity layer until an extensive area of the band rests against both idler wheel 12 and tensioning wheel 13**. This is a simple means of avoiding damage to a strapping band, especially one made of plastic.

The powered tensioning wheel 13 mounted on pivoting lever 15 is pressed against the strapping band 10 supported on idler wheel 12 against the force of a spring 19 that engages lever 15. Spring 19 is a helical tension spring. One end of the spring is secured with a hook 20 to the free end of pivoting lever 15 and the other with a hook 21 to an immovable limiting surface 22. The force of spring 19 makes pivoting lever 15, and hence tensioning wheel 13, tend to assume an initial position in which tensioning wheel 13 and its associated idler wheel 12 are separated by an interval that exceeds the thickness of strapping band 10 and are ready to advance the band. In this initial position the pivoting lever 15 that supports tensioning wheel 13 is supported against immovable limiting surface 22 by an adjustable stop 23 that consists of a screw 24 and counternut 25. In the initial position the head of screw 24 rests against limiting surface 22 and can be adjusted to prevailing conditions.

The tensioning wheel 13 mounted on pivoting lever 15 assumes the initial position before tensioning while strapping band 10 is being advanced. As explained in the foregoing, the band is advanced and retracted with a pair of wheels 11 and 12 that press the band between them. This pair of wheels consists of an advance and retraction wheel 11 that is powered to rotate forwards and backwards by a separate motor, not illustrated, and of the same idler wheel 12 that operates in conjunction with tensioning wheel 13.

Idler wheel 12 rotates on one pivoting arm 26 of a rocker 27 that is maintained by a helical tension spring 29 in an initial position in which idler wheel 12 is pressed against strapping band 10, which is supported on powered advance and retraction wheel 11. Idler wheel 12 is accordingly forced against advance and retraction wheel 11 by spring-loaded rocker 27, tensioning strapping band 10 between wheels 11 and 12. The surface 30 of advance and retraction wheel 11 is made of polished metal to reduce the friction between wheel 11 and band 10. Enough force is still transferred to strapping band 10, however, to advance it in the band guide 45 that surrounds but does not contact the package. The force is also powerful enough to retract strapping band 10 into position against the package by reversing the sense in which advance and retraction wheel 11 rotates once the front end of the band has been secured.

The pivoting lever 15 that tensioning wheel 13 is mounted on and the rocker 27 that idler wheel 12 is mounted on pivot on a common journal 31. Thus, only one journal is employed for the two pivoting parts 15 and 27.

The idler wheel 12 mounted on rocker 27 is, as is especially evident from FIG. 2, displaced, while strapping band 10 is tensioned, by the pressure deriving from powered tensioning wheel 13 and affecting idler wheel 12 against the force of spring 29 into a release position in which powered advance and retraction wheel 11 and its associated idler wheel 12 are separated at an interval that exceeds the thickness of strapping band 10 and are ready to tension the band. This is a simple means of preventing advance and retraction wheel 11 from impeding the tensioning of strapping band 10.

A stop 32 that operates in conjunction with the first pivoting arm 26 is associated with rocker 27 to limit its pivoting motion into the release position. This is a simple means of preventing the rocker from pivoting too far out of the release position.

A switch 33 with an adjustable time-lag relay that is not illustrated is associated with stop 32. The motor 49 with shaft 51 that powers tensioning wheel 13 can be turned off with switch 33.

The operation of the apparatus in accordance with the invention will now be described.

The pair of wheels 11 and 12 that press strapping band 10 between them advances the band in the band guide that surrounds the package without contacting it. At this stage the apparatus is in the initial position illustrated in FIG. 1 in which idler wheel 12 and spring-loaded rocker 27 are forced against strapping band 10, which is supported on advance and retraction wheel 11. Since idler wheel 12 and tensioning wheel 13 are separated, the band can be freely advanced between them. There is a band guide 37 partially surrounding idler wheel 12 and a band guide 38 partially surrounding tensioning wheel 13 to hold strapping band 10 in place around wheel 12 and 13. Band guides 37 and 38 are mounted on rocker 27. Strapping band 10 is advanced just by moving advance and retraction wheel 11 in the advancing direction with tensioning wheel 13 not operating.

Once strapping band 10 has been completely advanced in the band guide that surrounds but does not contact the package, the band is retracted with its front end secured in place until it rests against the package. The band is retracted by reversing advance and retraction wheel 11. The motor that powers tensioning wheel 13 is turned on, rotating wheel 13 in the tensioning sense, at the same time that advance and retraction wheel 11 is reversed. Tensioning wheel 13 is rotated slowly and at high power. The feed and tension directions of band 10 are designated in FIG. 1 by arrows 52 and 53, respectively.

Once strapping band 10 is in contact with the package and as it continues to be retracted the tension in it increases, shifting tensioning wheel 13, which is mounted on pivoting lever 15, against the force of spring 19 out of its initial position and into its operating position, in which tensioning wheel 13 comes to rest first against strapping band 10 and then, along with the band, against idler wheel 12. Tensioning wheel 13 continues to retract, tension in other words, strapping band 10. Advance and retraction wheel 11 is at first still resting against strapping band 10 as the band continues to be tensioned. The pressure of tensioning wheel 13 against idler wheel 12, however, shifts rocker 27 against the force of spring 29 out of its initial position and into its release position. Rocker 27 is shifted, along with idler wheel 12 against the force of spring 29 out of its initial position and into its release position in accordance with the increasing tension in strapping band 10 and the accordingly increasing pressure with which tensioning wheel 13 is forced against idler wheel 12. Switch 33 with the adjustable time-lag relay turns on while rocker 27 is being shifted into its release position and activates the motor 49 that powers the shaft 14 of tensioning wheel 13. The relay can be set to turn on the motor that powers the shaft 14 of tensioning wheel 13 either immediately or after a predetermined interval, precisely determining how long tensioning wheel 13 will continue to run and the tension in strapping band 10 to increase. The motor 46 with shaft 48 that powers advance and retraction wheel 11 turns off of course when the motor 49 that powers tensioning wheel 13 turns on.

It is difficult for the operator to control the tension in the strapping band with the adjustable time-lag relay because the proper levels must be learned from experience. When the length of the loop of strap changes or the material that the package is made out of differs, other time intervals must be set. To eliminate this problem the motor can also be turned on in accordance with the tension already prevailing in the band. An adjustably pretensioned accumulator 34 that can be loaded parallel to the direction of pivot is accordingly associated with the second pivoting arm 28 of rocker 27. Rocker 27 is accordingly shifted into the release position against the force of accumulator 34 and will have to overcome that force before switch 33 turns on. Switch 33 operates in this case without a time-lag relay. Accumulator 34, which can be loaded parallel to the direction of pivot by rocker 27, consists of a helical compression spring, one end of which rests on a piston 35 that is supported against a stop 36 and that operates in conjunction with rocker 27 and the other end of which rests on a bolt 39 that can be adjusted parallel to the direction of load. Piston 35, helical compression-spring accumulator 34, and bolt 39 slide in a housing 40 mounted on limiting surface 22. The stop 36 for piston 35 is a spring washer, not illustrated, inserted in an annular groove in the cylindrical housing 40. A carrier 41 in piston 35 extends out of housing 40 and engages the second pivoting arm 28 of rocker 27, braking the pivoting motion of the rocker in the release position in accordance with the level of tension prevailing at that moment in strapping band 10.

The adjustable bolt 39 that rests against accumulator 34 has a wedge surface 42 on the side facing away from the accumulator. Wedge surface 42 functions as a seating for a ball 43. The position of ball 43 against wedge surface 42 can be adjusted perpendicular to the direction of load by means of a threaded shaft 44. Varying the position of the ball against the wedge surface displaces bolt 39, changing the pretensioning of accumulator 34 and hence the force that counteracts the pivoting of rocker 27 into the release position. Rocker 27 will accordingly pivot in accordance with the level of tension prevailing in strapping band 10 against the force of accumulator 34, allowing the tension to be precisely adjusted to activate the switch 33 that turns off the motor that powers tensioning wheel 13.

Once the predetermined level of tension has been attained in the band looped around the package, the overlapping ends of the band can be fastened together and the length of band that is not utilized for wrapping the package can be cut off. The design of the mechanisms employed for this purpose can be in itself known and they are accordingly not described in greater detail herein. Once the unutilized length of wrapping band has been cut off, the band can be advanced again.

The embodiment of the invention described herein is only one example of the invention, which is not restricted to that embodiment, many other embodiments and applications being possible as well.

We claim:

1. Support and tensioning apparatus for a strapping band to be tensioned around a package, comprising: a pair of wheels of which one wheel is an idler wheel and the other wheel is a tensioning wheel for tensioning said strapping band; tensioning motor means for driving said tensioning wheel in tensioning direction and having a shaft; a pivoting lever, said shaft of said tensioning motor means being mounted in said pivoting lever, said tensioning wheel pressing against the strapping band while the band is being tensioned and rests on the idler wheel and is looped partially around said tensioning wheel, said tensioning wheel pressing against said band with a force that increases with the tension in the band; a band guide surrounding said package without contacting said package, said band being first placed between said idler wheel and an advance and retraction wheel and advanced in said band guide and being subsequently retracted with its front end secured in place into a position against the package by reversing rotation of said pair of wheels, said band being thereafter tensioned with said tensioning wheel rotating substantially slowly and at high power, said tensioning wheel pressing against said band with a pressing force that increases with tension in said band when said band is being tensioned and contacts said idler wheel, frictional forces arising on the partially looped part of said tensioning wheel due to said pressing force being additive to said pressing force and being applied with said pressing force to said idler wheel.

2. Support and tensioning apparatus as defined in claim 1 and means for rotating said tensioning wheel in a direction in which one component of its force tends to separate the pair of wheels even though that component is weaker than the pressure generated by said pivoting lever as result of tension in the band.

3. Support and tensioning apparatus as defined in claim 1, wherein said tensioning wheel has a metallic surface with irregularities to increase its coefficient of friction.

4. Support and tensioning apparatus as defined in claim 1, wherein said idler wheel has a surface lying against the strapping band and comprises an anti-friction, low-elasticity layer.

5. Support and tensioning apparatus as defined in claim 1, wherein said tensioning wheel deflects the strapping band so that the length of band extending to the package at least approximately parallels the direction in which the tensioning wheel mounted on said pivoting lever applies pressure.

6. Support and tensioning apparatus as defined in claim 1, including spring means engaging said lever, said tensioning wheel mounted on said pivoting lever being pressable against the strapping band supported on the idler wheel against the force of said spring means engaging said lever.

7. Support and tensioning apparatus as defined in claim 6, wherein said tensioning wheel mounted on said pivoting lever is, before tensioning and while the strapping band is being advanced, maintained by said spring means in an initial position, said tensioning wheel and its associated idler wheel being separated in said initial position by an interval exceeding the thickness of the strapping band, said tension wheel and idler wheel being ready to advance the band when in said initial position.

8. Support and tensioning apparatus as defined in claim 1, and an adjustable stop, said pivoting lever being supportable in an initial position against an immovable limiting surface by said adjustable stop.

9. Support and tensioning apparatus as defined in claim 1, wherein said advance and retraction wheel is rotatable forwards and backwards, and a separate motor for driving said advance and retraction wheel.

10. Support and tensioning apparatus as defined in claim 9, wherein said idler wheel operating in conjunction with said advance and retraction wheel is the same wheel that operates in conjunction with said tensioning wheel.

11. Support and tensioning apparatus as defined in claim 9, wherein said advance and retraction wheel has a polished metal surface.

12. Support and tensioning apparatus as defined in claim 9, including rocker means with a pivoting arm, said idler wheel rotating on said pivoting arm, in an initial position, said idler wheel being held in said initial position against the strapping band which is supported on said advance and retraction wheel.

13. Support and tensioning apparatus as defined in claim 12, wherein said pivoting lever and said rocker means pivot on a common journal.

14. Support and tensioning apparatus as defined in claim 12, wherein said idler wheel mounted on said rocker means is displaced against spring force into a release position while the strapping band is being tensioned by pressure from the tensioning wheel and affecting the idler wheel, said advance and retraction wheel and associated idler wheel being separated in the release position at an interval exceeding the thickness of the band and being ready to tension the band.

15. Support and tensioning apparatus as defined in claim 14, including a stop associated with said rocker means to limit its pivoting motion into the release position.

16. Support and tensioning apparatus as defined in claim 14, including a switch actuatable when said release position is attained, said switch having an adjustable time-lag relay that turns off the motor for said tensioning wheel and being associated with said rocker means.

17. Support and tensioning apparatus as defined in claim 14, including an adjustably pretensioned accumulator that can be loaded parallel to the direction of pivot, and a switch actuatable once the release position has been attained for turning off the motor driving said tensioning wheel, said accumulator and switch being associated with said rocker means.

18. Support and tensioning apparatus as defined in claim 17, wherein said accumulator that can be loaded parallel to the direction of pivot by said rocker means comprises a helical compression spring having one end resting on a piston, a stop supporting said one end, said one end operating in conjunction with said rocker means, and a bolt, said spring having another end resting on said bolt, said bolt being adjustable parallel to the direction of load.

19. Support and tensioning apparatus as in claim 18, wherein said adjustable bolt rests against said accumulator and has a wedge surface located on a side facing away from the accumulator, a ball and threaded shaft, said bolt forming a seating for said ball having a position against the wedge surface which can be adjusted perpendicular to the direction of load by said threaded shaft.

* * * * *